US005140508A

United States Patent [19]

Komonko

[11] Patent Number: 5,140,508

[45] Date of Patent: Aug. 18, 1992

[54] CLAMP-ON MAGNET FOR TROUBLE LAMPS

[76] Inventor: James R. Komonko, 101 Somer Dr., Sitka, Ak. 99835

[21] Appl. No.: 718,960

[22] Filed: Jun. 21, 1991

[51] Int. Cl.[5] ..... F21V 21/08

[52] U.S. Cl. ..... 362/396; 362/398; 362/427; 248/316.5

[58] Field of Search ..... 362/376, 396, 398, 418, 362/427; 248/316.1, 316.5, 316.7, 206.5, 683, 313; 24/499, 510, 543, 546, 563, 67.9

[56] References Cited

U.S. PATENT DOCUMENTS

| | | | |
|---|---|---|---|
| 366,863 | 7/1887 | Naylor | 248/316.7 |
| 754,285 | 3/1904 | Dick | 248/316.5 |
| 910,158 | 1/1909 | Walker | 362/396 |
| 1,087,664 | 2/1914 | Keller | 248/316.5 |
| 1,561,554 | 11/1925 | Little . | |
| 1,603,171 | 10/1926 | Wade . | |
| 1,932,143 | 10/1933 | Piercy . | |
| 2,432,435 | 12/1947 | Millette | 248/316.5 |
| 2,506,400 | 5/1950 | Wietz | 362/398 |
| 2,747,077 | 5/1956 | Salm | 248/206.5 |
| 2,747,079 | 5/1956 | Kubiliunas | 248/206.5 |
| 3,559,934 | 2/1971 | Jensen | 248/316.5 |
| 4,019,047 | 4/1977 | Frey . | |
| 4,727,462 | 2/1988 | Komonko . | |
| 4,985,817 | 1/1991 | Yale | 362/398 |

FOREIGN PATENT DOCUMENTS

| | | | |
|---|---|---|---|
| 568235 | 8/1960 | Belgium | 248/316.1 |
| 1039703 | 10/1978 | Canada | 248/15 |
| 674557 | 4/1939 | Fed. Rep. of Germany | 248/316.7 |
| 931148 | 2/1948 | France | 248/316.7 |
| 1103160 | 10/1955 | France | 248/316.7 |

*Primary Examiner*—Richard R. Cole
*Attorney, Agent, or Firm*—Henderson & Sturm

[57] ABSTRACT

An apparatus (10) for connection to a trouble light (11); wherein, the apparatus (10) includes a magnet (12) captively secured between steel plates (13) and (14); wherein, one of the plates (14) is provided with flanges (16) (17) having threaded fasteners (18) (19) connected thereto, to captively engage the helical coil (29) of a one piece spring having interlocked handles (23) and (27); such that the interlocked handles (23) and (27) may be forced together to enlarge the opening between said handles (23) (27) to receive a portion of a trouble light (11).

1 Claim, 1 Drawing Sheet

CLAMP-ON MAGNET FOR TROUBLE LAMPS

TECHNICAL FIELD

The present invention relates generally to a clamp-on magnet for trouble lamps and more particularly to such an apparatus which will quickly and easily attach to either a florescent trouble lamp or the handle of an incandescent trouble lamp and which allows the direction of the light to be easily adjusted.

BACKGROUND ART

Trouble lamps, or drop lights as they are often called, are commonly used to provide light on a temporary basis to a place where light is not always needed. For example, automobile mechanics commonly use these kinds of lamps to direct the light to that portion of a vehicle upon which they are working.

U.S. Pat. No. 1,561,554 to Little shows a magnetic attachment to a trouble lamp so that the trouble lamp can be held against a metallic surface, such as a car. A problem with this early magnetic attachment is that the light cannot be easily adjusted to direct the light where needed.

U.S. Pat. No. 1,603,171 to Wade shows an electromagnetic structure attached to a trouble light. This apparatus also lacks the ability to easily and quickly adjust the direction of the light from the trouble lamp. U.S. Pat. No. 1,932,143 to Piercy shows a clamp with threaded fasteners for attachment to a trouble lamp. While the direction of the light from the trouble lamp can be adjusted, threaded fasteners must be used to attach the apparatus to a trouble lamp and, of course, these fasteners must be removed if it is desired to use the magnet attachment on a different trouble lamp.

U.S. Pat. No. 4,019,047 to Frey is similar to the aforementioned Little patent because it has a magnet, but the trouble light cannot be easily adjusted to direct the light in a particular direction with the Frey structure.

U.S. Pat. No. 4,727,462 to Komonko shows a trouble light with a magnet for attachment to the shield or reflector of an incandescent trouble light. This structure cannot, however, be used on florescent trouble lights, so there is a need for a more universal device of this type which can be used on both incandescent and florescent trouble lamps.

DISCLOSURE OF THE INVENTION

The present invention relates to an apparatus for connection to a trouble light including a magnet and a housing connected to the magnet. A pair of spaced apart parallel flanges extend from the housing and each flange has a hole therein. The first wire spring clamp section has a helical central portion with a longitudinal axis.

A pair of arms, each extending from the helical central portion, is provided for selectively extending around a portion of the light. The arms are biased to a first position by the helical spring portion wherein they are less than 90° apart and are relatively movable to a second position wherein the arms are farther apart than they are in the first position thereof. The first wire spring clamp section is pivotally attached to one of the flanges along the longitudinal axis of the helical portion of the first spring clamp section The second wire spring clamp section is provided which is substantially identical to the first wire spring clamp section and is pivotally attached to the other one of the flanges along the longitudinal axis whereby the arms of the first and second wire spring clamp sections can be placed around a portion of the trouble light, while at the same time permitting a magnet to be pivoted with respect to the trouble light so that the direction of light can be adjusted. All of these arms have an inwardly facing arcuate section which permits the arms to clamp around either a florescent bulb or the handle of an incandescent trouble lamp.

A first handle is provided for connecting one of the arms of the first wire spring clamp section to one of the arms of the second wire spring clamp section and a second handle is provided for connecting the other arm of the first wire spring clamp section to the other arm of the second wire spring clamp section whereby a person can grasp the first and second handles to pull them together and thereby move the pairs of arms on the first and second wire spring clamp sections apart for attaching or removing the first and second wire spring clamp sections onto or off from a trouble light of any type.

An object of the present invention is to provide an improved clamp-on magnet for trouble lamps.

Another object of the present invention is to provide a clamp-on magnet for trouble lights which is universal enough to be easily used in conjunction with either a florescent or an incandescent type of trouble lamp.

A further object of the present invention is to provide a clamp-on magnet for trouble lights which has handles on the arms thereof so that the trouble lamp can be loosened or tightened with one hand, while the other hand holds the trouble light.

Other objects, advantages, and novel features of the present invention will become apparent from the following detailed description of the invention when considered in conjunction with the accompanying drawings.

BEST MODE FOR CARRYING OUT THE INVENTION

Figure 1:
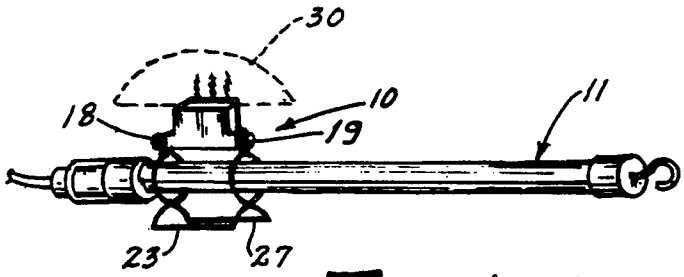
FIG. 1 is a perspective view of a preferred embodiment of the present invention shown attached to a florescent trouble light.

Referring now to the drawings wherein like reference numerals designate identical or corresponding parts throughout the several views, FIG. 1 shows a clamp-on magnet apparatus (10) constructed in accordance with the present invention and clamped onto a florescent trouble lamp (11).

Figure 3:
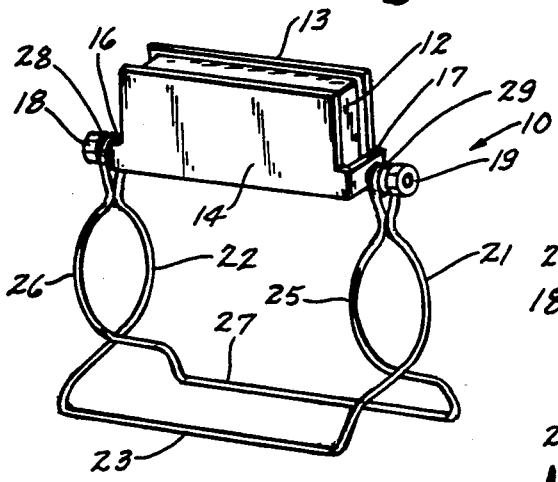
FIG. 3 is a perspective view of the preferred embodiment shown in FIGS. 1 and 2, disconnected from a trouble light.
Figure 4:
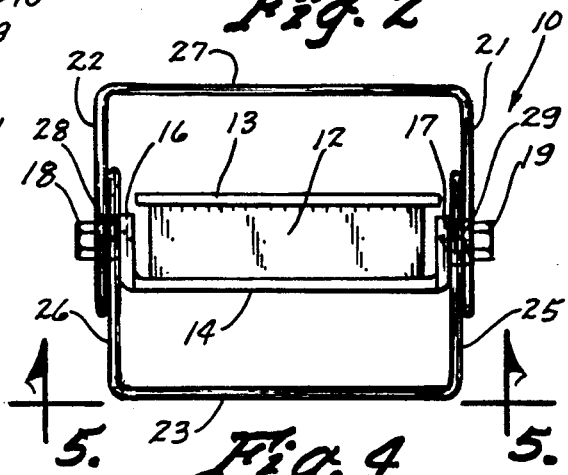
FIG. 4 is a top plan view of the preferred embodiment.
Figure 5:
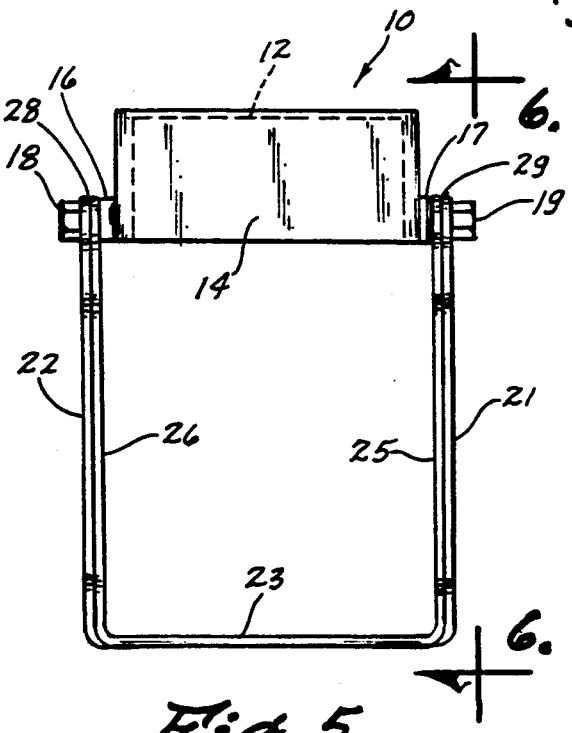
FIG. 5 is a side elevational view of the preferred embodiment of the present invention.

FIG. 3 shows a ceramic magnet (12) having a plate (13) of steel or the like held tightly to one side thereof by magnetic forces on the magnet and a second plate (14) of steel also held to the magnet (12) by magnetic forces. The plates (13) and (14) are also glued to the magnet (12) by epoxy or double faced tape, such as the 3M brand adhesive vinyl foam tape. Flanges (16) and (17) are formed as part of the metal plate (14) and have a threaded fastener (18) and (19) connected respectively thereto. Arms (21) and (22) are connected together by a handle (23). Arms (25) and (26) are connected together by a handle (27). Arms (21) and (25) are connected together in one piece by a helical portion (29) which extends around the axis of the fastener (19). Similarly, a helical portion (28) is formed in one piece and connects with arms (22) and (26) such that all of the spring steel structure represented by elements (21), (22), (23), (25), (26), (27), (28) and (29) are all formed of essentially one solid piece of spring steel wire.

Figure 2:
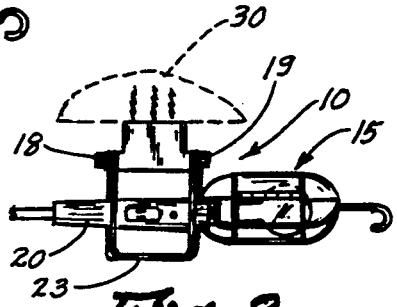
FIG. 2 is the same preferred embodiment of the present invention shown attached to an incandescent trouble light.

In operation, the magnet (13) can be attached to a magnetic piece of material (30), such as a portion of an automobile or the like to hold a trouble light such as florescent trouble light (11) or to hold an incandescent trouble light (15) by the handle (20) thereof. To attach either of the trouble lights (11) or (15) to the positions thereof shown in FIG. 1, the handles (23) and (27) would be grasped in one hand while the trouble light (11) or (15) would be grasped in the other hand. The handles (23) and (27) would be forced together to the position shown in dashed lines in FIG. 6 and then slid over either the trouble light (11) or the trouble light handle (20) as shown in FIGS. 1 and 2. Then, the handles (23) and (27) are released and the spring steel arms (21), (22), (25) and (26) will clamp around the trouble light (11) or (15) as shown in FIGS. 1 and 2.

Figure 6:
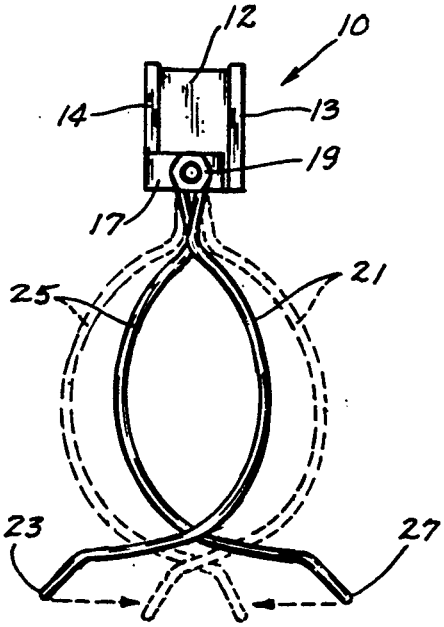
FIG. 6 is a side elevational view of the preferred embodiment of the present invention shown in solid lines in the position it would be in when there is no trouble light attached thereto and the arms are released and also shows in dashed lines the position of the arms of the present invention when the handles thereof are grasped with one hand and squeezed together to cause the arms to move apart at those times when the device is either being removed from or installed onto a trouble lamp.

When it is desired to move the holding apparatus (10) from either of the trouble lamps (11) or (15), the procedure is merely reversed, wherein one hand is used to bring the handles (23) and (25) together which moves the arms apart to the position shown in dashed lines in FIG. 6 whereupon the trouble lamp can be detached from the device (10).

It will furthermore be appreciated that this attachment or detachment from trouble lamps (11) and (15) can be accomplished either when the magnet (12) is attached to a metallic object (30) or not. It may, for example, be more convenient to first attach the device (10) to the trouble lamp, and then take the combination of trouble lamp and device (10) to the place where it is to be used whereupon it would then be placed against a metal surface (30) and then the arms and trouble lamp could be pivoted to the position desired by pivoting about the axis of concentric fasteners (18) and (19).

Accordingly, it will be appreciated that the preferred embodiment (10) does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. Apparatus for connection to a trouble light, said apparatus consisting of:

a magnet;

a housing connected to said magnet;

a pair of spaced apart parallel flanges extending from said housing, each flange having a hole therein;

a first wire spring clamp section having a helical central portion with a longitudinal axis, and a pair of arms, one arm extending from said helical central portion, each of said arms having means disposed thereon for selectively extending around a portion of said light, said arms being biased to a first position wherein they are less than 90 degrees apart and being relatively movable to a second position wherein the arms are farther apart than they are in the first position thereof;

means extending through the hole in one of the flanges for pivotally attaching said first wire spring clamp section to said one of the flanges along the longitudinal axis of said helical central portion of said first spring clamp section;

a second wire spring clamp section substantially identical to said first wire spring clamp section; and means extending through the hole in the other one of the flanges for pivotally attaching said second wire spring clamp section to said other one of the flanges along said longitudinal axis whereby the arms of the first and second wire spring clamp section can be placed around said portion of the trouble light while at the same time permitting the magnet to be pivoted with respect to the trouble light so that the direction of the light can be adjusted; the improvement comprising;

all of said arms having inwardly facing arcuate sections thereon;

first elongated handle means for connecting one of the arms of said first wire spring clamp section to one of the arms of said second wire spring clamp section;

second elongated handle means for connecting the other arm of said first wire spring clamp section to the other arm of said second wire spring clamp section wherein the second elongated handle means and a portion of said other arms of the first and second wire spring clamp sections are captively retained by the first elongated handle means and said one of the arms of the first wire spring clamp and the said one of the arms of the second wire spring clamp sections whereby a person can grasp said first and second handle means to pull them together and thereby move said pairs of arms on the first and second wire spring clamp sections apart for attaching or removing said first and second wire spring clamp sections to or from a trouble light wherein said first and second wire spring clamp sections are of one piece construction; and, means for causing the arms attached to said first handle means to move apart from the arms attached to the second handle means as said first and second handle means are pulled together.

* * * * *